US007302896B2

(12) United States Patent
Polidar et al.

(10) Patent No.: US 7,302,896 B2
(45) Date of Patent: Dec. 4, 2007

(54) TABLE FOR SELF-SERVICE SHOPS

(75) Inventors: Franz Polidar, Jettingen-Scheppach (DE); Manfred Handerer, Winterbach (DE)

(73) Assignee: Wanzl Metallwarenfabrik GmbH, Leipheim (DE)

( * ) Notice: Subject to any disclaimer, the term of this patent is extended or adjusted under 35 U.S.C. 154(b) by 159 days.

(21) Appl. No.: 10/819,276

(22) Filed: Apr. 7, 2004

(65) Prior Publication Data

US 2004/0187746 A1 Sep. 30, 2004

Related U.S. Application Data

(63) Continuation-in-part of application No. PCT/DE02/02800, filed on Jul. 31, 2002.

(30) Foreign Application Priority Data

Jun. 11, 2002 (DE) ..... 102 25 989

(51) Int. Cl.
*A47B 3/00* (2006.01)

(52) U.S. Cl. ..... 108/115; 108/27; 108/135

(58) Field of Classification Search ..... 108/11, 108/14, 18, 27, 115, 116, 121, 149, 157.1, 108/159, 157.16, 157.17, 159.12, 173, 175; 5/99.1; 16/382, 383, 387, 388; 211/85, 211/126.6, 132.1, 149, 195, 201
See application file for complete search history.

(56) References Cited

U.S. PATENT DOCUMENTS 174,257 A * 2/1876 Kibbey ..... 5/179
526,081 A * 9/1894 Mackie ..... 5/99.1
2,823,390 A * 2/1958 Hagelfeldt ..... 5/99.1
3,699,594 A * 10/1972 Matthey-Doret ..... 5/99.1
3,722,009 A * 3/1973 Hrynda ..... 5/93.1
4,057,873 A * 11/1977 Bursani ..... 16/388
4,089,467 A * 5/1978 Makowicki ..... 220/315

FOREIGN PATENT DOCUMENTS

| | | |
|---|---|---|
| DE | 29914238 | 10/1999 |
| DE | 10115033 | 10/2001 |
| GB | 1050176 | 12/1966 |
| GB | 2272833 | 6/1994 |

* cited by examiner

*Primary Examiner*—James O. Hansen
*Assistant Examiner*—Philip Gabler
(74) *Attorney, Agent, or Firm*—Buchanan Ingersoll & Rooney PC

(57) ABSTRACT

A table (1) for self-service shops includes a base frame (2) with four tubular feet (3), two side frames (16) arranged parallel and each having a first and a second wall (17, 18), and a bottom (22) arranged above the base frame (2) and surrounded by the walls (17, 18), wherein each side frame (16) is provided with two tubular uprights (15) carrying the walls (17, 18) and connected to the feet (3) of the base frame (2) by connectors so that the opposing cut surfaces (9) of the feet (3) and the uprights (15) are either arranged in a common plane (10) or are spaced apart in different planes (10').

12 Claims, 3 Drawing Sheets

TABLE FOR SELF-SERVICE SHOPS

CROSS-REFERENCE TO RELATED APPLICATIONS

The present application is a continuation of PCT/DE02/02800, filed on Jul. 31, 2002, and which claims the priority of DE 102 25 989.5, filed in Germany on Jun. 11, 2002. The contents of PCT/DE02/02800 and DE 102 25 989.5 are incorporated herein by reference.

BACKGROUND OF THE APPLICATION

1. Field of the Invention

The present invention relates to a table for self-service shops, comprising a base frame with four tubular feet, two side frames arranged parallel and each having a first and a second wall, and a bottom arranged above the base frame and surrounded by the walls.

2. Description of Related Art

Tables of this type are known in various designs. What is common to all these tables is that they can be converted into a space-saving form for the purpose of transportation, for example for delivery. Various solutions are known for this.

German utility model specification 299 14 238.8 describes such a table. This table can be converted into a usable form by fitting various individual parts together. For example, connecting parts first have to be inserted into the feet of a base frame before four uprights, which carry the side walls, can then be plugged onto these connecting parts.

OBJECTS AND SUMMARY

An object of the invention is to form a table in such a way that the aforementioned plug-in connections can be dispensed with. Nevertheless, the table should be foldable. Furthermore, this table should be formed so that a plurality of folded tables can be stacked on top of one another.

The object is achieved in that in one embodiment of the invention each foot is connected to one of the uprights by a hinge and in that the horizontal axis of each hinge is located either in or below the common plane.

If, as described hereinbelow, two uprights are rigidly connected to a first wall, and a second wall is mounted on one of the two uprights so as to be pivotable to a limited extent about a vertical axis, the solution found offers the following advantages:

The side frames with their walls can be moved about the hinges into a space-saving position of non-use. The bottom simply has to be removed and laid on the base frame beforehand.

In the folded-down position, the first and second walls hold the bottom, which is lying on the base frame, firmly in place.

In this position, the table is like a flat stack, with the result that the table can be dispatched and transported in a space-saving manner.

The upwardly visible region of the four feet is exposed when the four uprights are folded down. A second, likewise folded table, etc. can then be placed onto the feet of a first folded table so that a plurality of tables form a type of tower which, when tied appropriately to secure it, can be excellently transported.

To assemble the table into the position of use, the two side frames simply have to be brought into an upright position, each second wall secured to an adjacent upright and the bottom then inserted between the four walls without the need for any additional fixing means.

In a first embodiment, the hinge straps are arranged on the outsides of the uprights and the feet. In a further embodiment, the hinge straps are in block form to enable them to be inserted into the uprights and the feet.

BRIEF DESCRIPTION OF THE DRAWINGS

The invention will be further described with reference to the two embodiments.

DETAILED DESCRIPTION OF THE PREFERRED EMBODIMENTS

Figure 1:
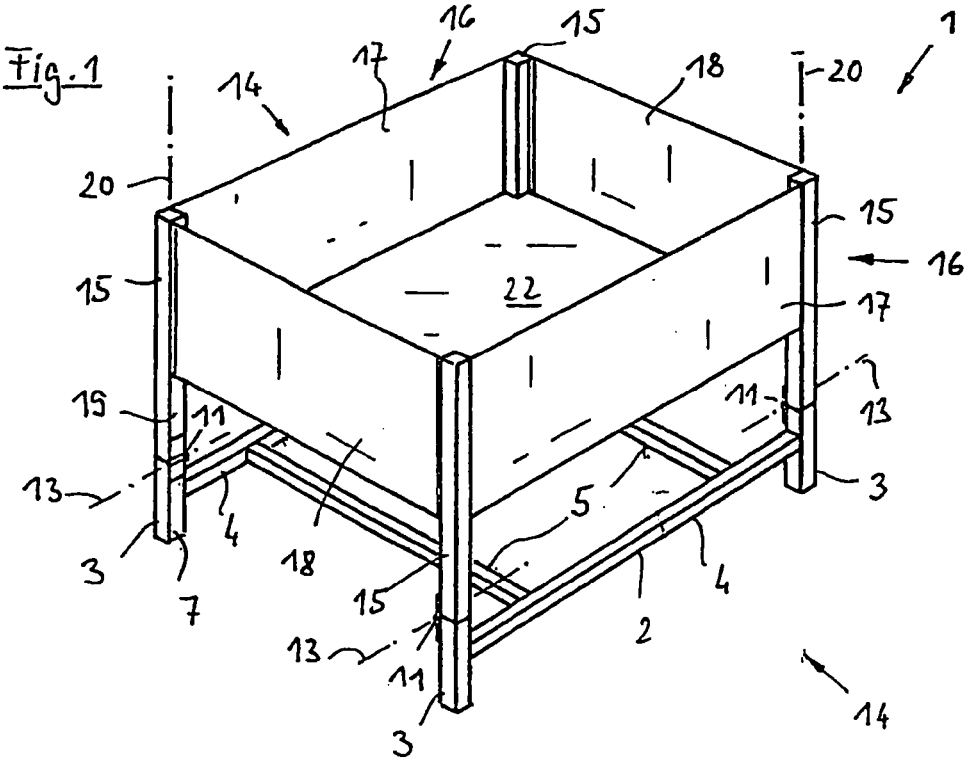
FIG. 1 shows a table according to one embodiment of the invention in the position of use.

The foldable table 1 shown in FIG. 1 is intended for self-service shops, where it is used for displaying goods. The table 1 has a base frame 2 provided with four feet 3. The feet 3 are connected by two horizontal longitudinal struts 4. The two longitudinal struts 4 are in turn connected by two further, horizontally arranged transverse struts 5, giving the base frame 2 an extremely stable structure. In the example, the feet 3 and the longitudinal and transverse struts 4, 5 are formed from square tubing. The same also applies to the four uprights 15, which extend upwards from the feet 3. Each upright 15 is connected so as to be pivotable about a horizontal axis 13 by means of a hinge 11 arranged on the inner surface 19 of the uprights 15 and the inner surface 7 of the feet 3. Two uprights 15 on each longitudinal side 14 of the table 1 carry a first wall 17, thereby forming two side frames 16. On each side frame 16, a second wall 18 is articulated on one of the diagonally opposing uprights 15 so that each second wall 18 is pivotable about a vertical axis 20. Each second wall 18 is detachably secured to the opposing free upright 15 with a known latching mechanism. A bottom 22, arranged within the walls 17 and 18 and above the base frame 2, is insertable between the walls 17, 18 from above and is downwardly supported on at least two of the walls 17 and/or 18. In a preferred embodiment, the walls 17, 18 include projections 28 for supporting the bottom 22.

Figure 2:
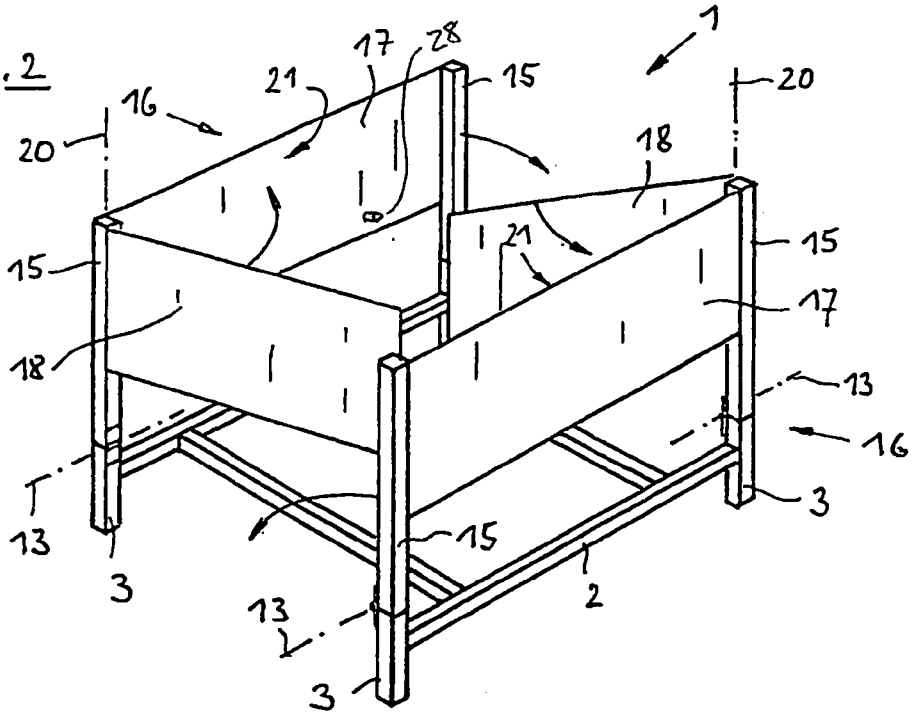
FIG. 2 shows the same table at the start of being folded.

FIG. 2 shows the start of the process of folding the table 1 described in FIG. 1. The bottom 22 has been removed upwards from the walls 17, 18 and lies (not shown) on the base frame 2. The second walls 18 have been detached from the opposing uprights 15 and are being pivoted in the direction of the arrow towards the inside 21 of the first wall 17 of their side frame 16. Next, each side frame 16 is successively folded downwards through approximately 90° onto the bottom 22 lying on the base frame 2; see arrows. It will easily be understood that the table 1 folded in this manner forms a flat stack.

Figure 3:
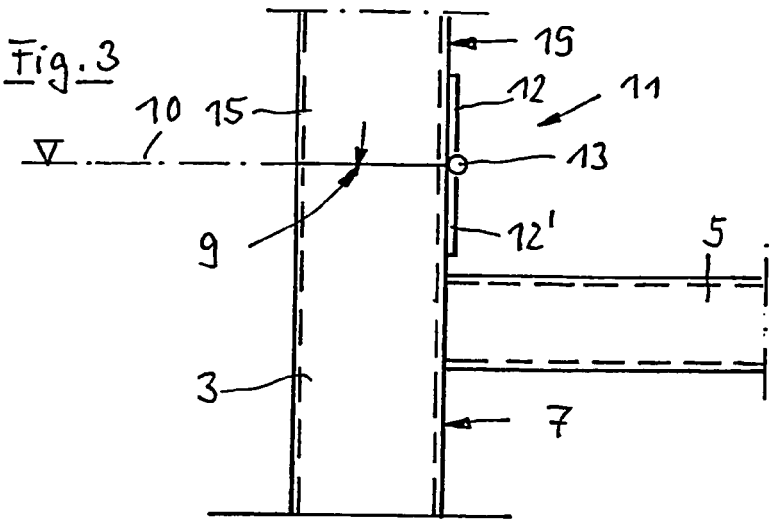
FIG. 3 shows a detail of the connecting region between a foot and an upright.

FIG. 3 shows a detail of a foot 3 and an upright 15 articulated on the foot 3. Part of a transverse strut 5 is visible at the foot 3. The cut surfaces 9 of the foot 3 and the upright 15 lie on top of one another. They also lie in a common plane 10. The horizontally arranged axis 13 of the hinge 11 serving as a connecting means also lies in this plane 10 or slightly lower. The upwardly extending hinge strap 12 of the hinge 11 is fixedly connected to the inner surface 19 of the upright 15 and the downwardly extending hinge strap 12' is fixedly connected to the inner surface 7 of the foot 3. The inner surfaces 7 and 19 of the feet 3 and the uprights 15 of each side frame 16 are arranged opposite one another in mirror-image fashion. The drawing shows the upright 15 when the table 1 is in the position of use.

Figure 4:
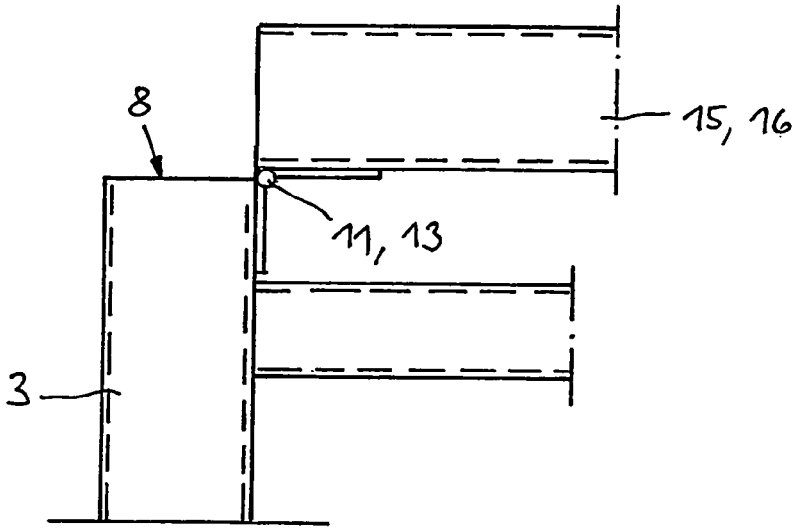
FIG. 4 shows the same detail with the upright folded down.

FIG. 4 shows the detail described in FIG. 3, but with the upright 15 folded down. It can clearly be seen from the drawing that the upper edge 8 of the foot forms an upper opening of the foot 3 and is accessible from above. Accordingly, each side frame 16 is folded down with the aid of two hinges 11.

Figure 5:
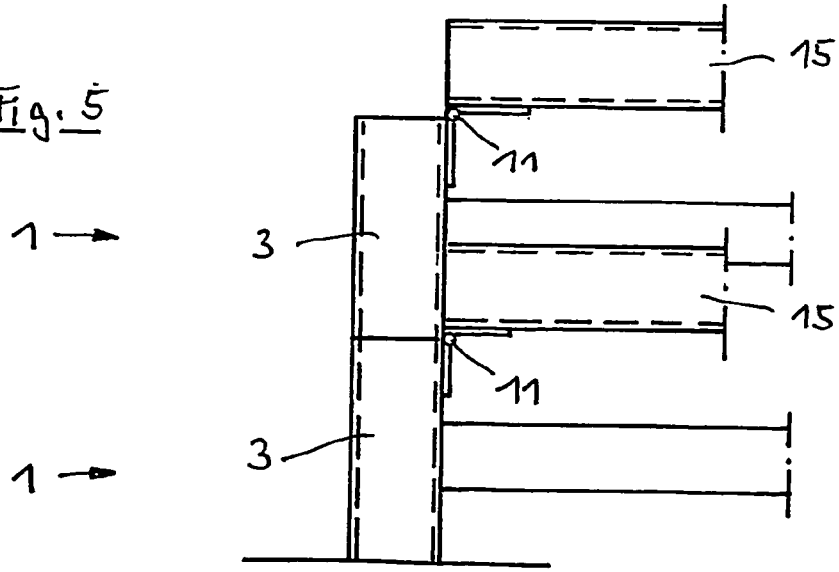
FIG. 5 shows a foot of a further table on a foot of the table shown here.

FIG. 5 shows a foot 3 of a first table 1 in the position of non-use, on which rests the foot 3 of a second table 1, also in the position of non-use. In this way, one table 1 after another can be stacked up, the feet 3 of an upper table 1 resting on the feet 3 of a lower table 1.

If one wishes to bring the table 1 out of the position of non-use back into the position of use, a first side frame 16 and then the second side frame 16 must first be pivoted upright. Next, the two second walls 18 have to be pivoted into their position of use and secured to the opposite upright 15. Lastly, the bottom 22 must be removed from the base frame 2 and inserted between the walls 17, 18 from above and supported on at least some of the walls 17, 18 in a suitable manner.

Figure 6:
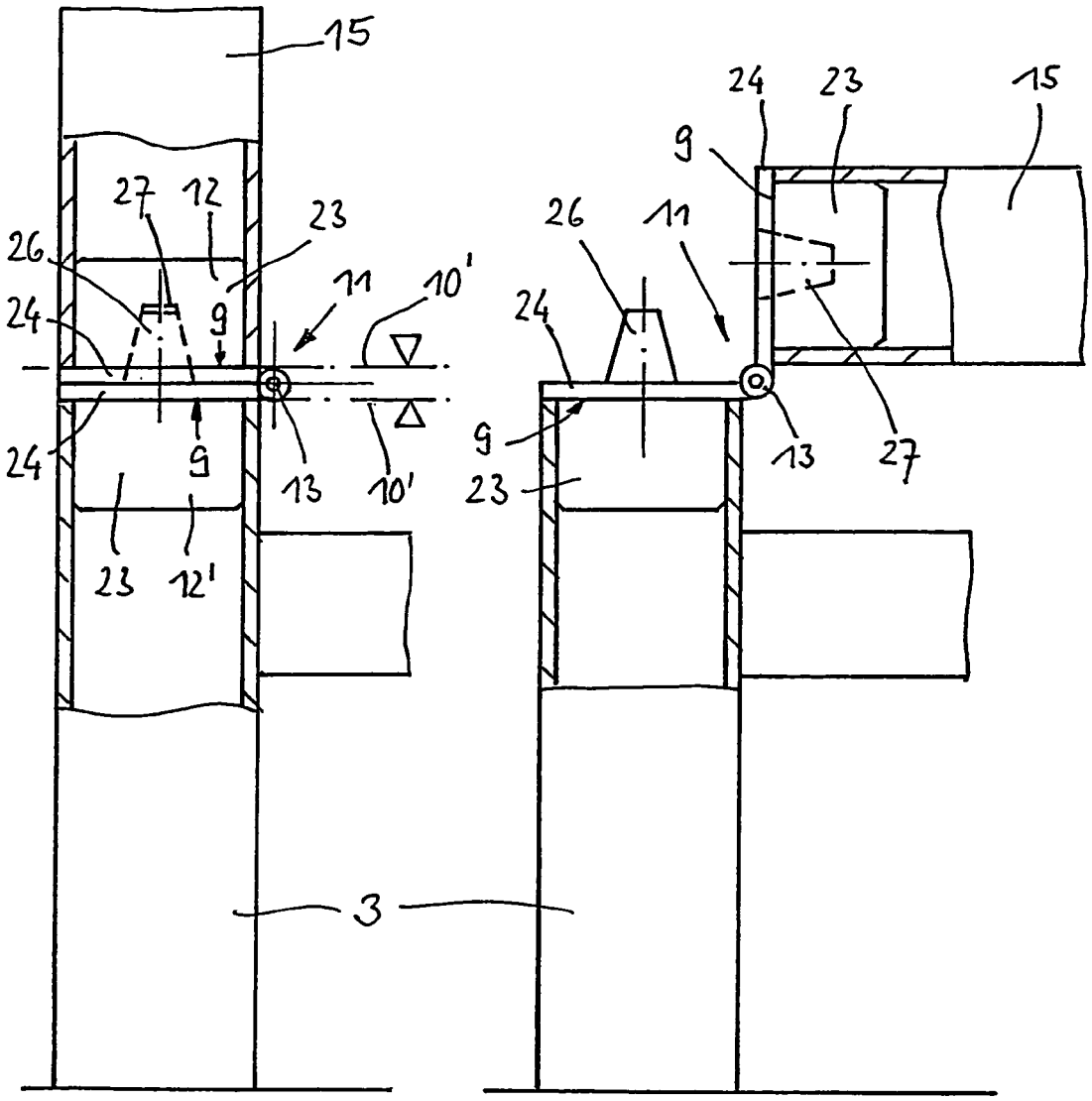
FIG. 6 shows two views of an arrangement with an insertable hinge.

FIG. 6 shows two views of a foot 3 and an upright 15 connected by means of a hinge 11, the hinge straps 12, 12' of which are arranged inside the foot 3 and the upright 15, while the horizontal axis 13 of the hinge 11 is arranged outside the foot 3 and the upright 15. Each hinge strap 12, 12' has a cap 23. The cap 23 of the lower hinge strap 12' is positively inserted into the hollow foot 3 and the cap 23 of the upper hinge strap 12 is positively inserted into the hollow upright 15 and secured against detachment in a suitable manner. Each cap 23 has a stop plate 24. The stop plate 24 of the lower hinge strap 12' lies on the cut surface 9 of the foot 3 and the stop plate 24 of the upper hinge strap 12 lies against the cut surface 9 of the upright 15. As the stop plates 24 have a certain thickness, the cut surfaces 9 each lie in a plane 10', the distance between which corresponds to twice the thickness of a stop plate 24. The horizontal axis 13 of the hinge 11 therefore lies between the two planes 10'. The hinge joint, which connects the upper and the lower hinge strap 12, 12', is formed in ways known to the person skilled in the art. The hinge straps 12, 12' can therefore be connected to one another either by means of a pivot pin or, if made of plastic, preferably also by means of an integral hinge. As a means of additionally securing and centering the arrangement shown, it is recommended to provide an elevation 26, e.g. in the form of a conical projection, on one of the two stop plates 24 and, exactly opposite (see left-hand drawing), a corresponding recess 27 or a suitable opening in the other stop plate 24 for receiving and securely locating the elevation 26. When the table 1 is in the position of use, the elevation 26 is located in the recess 27. It is unimportant on which stop plate 24 the elevation 26 is arranged and in which stop plate 24 the recess 27 is provided. The right-hand drawing shows a foot 3 with the upright 15 folded down. The hinges 11 which have just been described are usable on a table 1 in the same way and to the same effect as described in FIGS. 1 and 2.

Although only preferred embodiments are specifically illustrated and described herein, it will be appreciated that many modifications and variations of the present invention are possible in light of the above teachings and within the purview of the appended claims without departing from the spirit and intended scope of the invention.

| List of parts | |
|---|---|
| 1 | Table |
| 2 | Base frame |
| 3 | Feet |
| 4 | Longitudinal struts |
| 5 | Transverse struts |
| 6 | |
| 7 | Inner surface of the foot |
| 8 | Upper edge/opening of the foot |
| 9 | Cut surfaces of the foot/upright |
| 10 | Common plane |
| 10' | Planes |
| 11 | Hinge |
| 12, 12' | Upper, lower hinge strap |
| 13 | Horizontal axis of the hinge |
| 14 | Longitudinal side of the table |
| 15 | Upright |
| 16 | Side frame |
| 17 | First wall |
| 18 | Second wall |
| 19 | Inner surface of the upright |
| 20 | Vertical axis |
| 21 | Inside of the first wall |
| 22 | Bottom |
| 23 | Cap |
| 24 | Stop plate |
| 25 | Hinge joint |
| 26 | Elevation |
| 27 | Recess |

The invention claimed is:

1. A table for self-service shops, the table comprising:

a base frame with four tubular feet, said feet are immovable relative to the base frame, two side frames arranged parallel and each having a first and a second wall, projections extending from at least some of the walls, and a bottom arranged above the base frame and surrounded by the walls, wherein each side frame is provided with two tubular uprights which support the walls and is connected to the feet of the base frame by connectors so that opposing cut surfaces of the feet and the uprights are either arranged in a common plane or are spaced apart in different planes, wherein each foot is directly connected to one of the uprights by a respective hinge having a horizontal axis; and wherein the hinges enable each of the first walls to pivot from a first position in which each of the tubular uprights is substantially coaxial with a respective one of the four tubular feet to a second position in which the walls lie substantially horizontal, and when the walls are in the first position, the bottom is supported by the wall projections.

2. The table for self-service shops according to claim 1, wherein each hinge is arranged on an inner surface of one of the uprights and an inner surface of one of the feet.

3. The table for self-service shops according to claim 1, wherein each hinge is provided with two hinge straps and each hinge strap has a cap and one of the caps is inserted into one of the feet and another of the caps is inserted into one uprights.

4. The table for self-service shops according to claim 3, wherein each of the hinge straps is provided with a stop plate connected to the cap, and the stop plates are intended to rest against the surfaces of a foot and an upright.

5. The table for self-service shops according to claim 4, wherein for each hinge, an elevation is provided on one of the stop plates and a recess or an opening for receiving the elevation is provided in the other stop plate when the first walls are in the first position.

6. The table for self-service shops according to claim 5, wherein each first wall is fixedly connected to the two uprights of the respective side frame, and the second wall rotates with respect to one of the respective uprights about a vertical axis.

7. The table for self-service shops according to claim 4, wherein each first wall is fixedly connected to the two uprights of the respective side frame, and the second wall rotates with respect to one of the respective uprights about a vertical axis.

8. The table for self-service shops according to claim 1, wherein each first wall is fixedly connected to the two uprights of the respective side frame, and the second wall rotates with respect to one of the respective uprights about a vertical axis.

9. The table for self-service shops according to claim 1, wherein the bottom is removable.

10. The table for self-service shops according to claim 1, wherein the feet of a similar table can be placed on the feet of the table when the first walls are in the second position.

11. A table for self-service shops, the table comprising:

a base frame with four tubular feet, two side frames arranged parallel and each having a first wall and a second wall, projections extending from at least some of the walls, and a bottom arranged above the base frame and surrounded by the walls, wherein each side frame is provided with two tubular uprights which support the walls and is connected to the feet of the base frame by connectors so that opposing cut surfaces of the feet and the uprights are either arranged in a common plane or are spaced apart in different planes, wherein each foot is directly connected to one of the uprights by a hinge having a horizontal axis; and wherein the second wall of each of the side frames rotates about one of the two tubular uprights supporting the side frame, extends from one side frame to the other side frame and is detachably secured to one of the tubular uprights of the other side frame, and the bottom being supported by the wall projections.

12. The table for self-service shops according to claim 11, wherein the feet are immovable relative to the base frame.

* * * * *